US011085592B1

(12) United States Patent
Wang

(10) Patent No.: US 11,085,592 B1
(45) Date of Patent: Aug. 10, 2021

(54) LED LIGHT TUBE

(71) Applicant: XIAMEN LEEDARSON LIGHTING CO. LTD., Fujian (CN)

(72) Inventor: Linhua Wang, Fujian (CN)

(73) Assignee: XIAMEN LEEDARSON LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/915,874

(22) Filed: Jun. 29, 2020

(51) Int. Cl.

| | |
|---|---|
| ***F21V 15/015*** | (2006.01) |
| ***F21K 9/278*** | (2016.01) |
| ***F21K 9/272*** | (2016.01) |
| ***F21V 7/00*** | (2006.01) |
| ***F21V 29/70*** | (2015.01) |
| ***F21K 9/69*** | (2016.01) |
| ***F21V 14/04*** | (2006.01) |
| ***F21K 9/68*** | (2016.01) |
| ***F21V 14/02*** | (2006.01) |
| ***F21V 14/06*** | (2006.01) |
| *F21Y 103/10* | (2016.01) |
| *F21Y 115/10* | (2016.01) |
| *F21Y 107/50* | (2016.01) |

(52) U.S. Cl.
CPC ..... *F21K 9/278* (2016.08); *F21K 9/272* (2016.08); *F21K 9/68* (2016.08); *F21K 9/69* (2016.08); *F21V 7/005* (2013.01); *F21V 14/02* (2013.01); *F21V 14/04* (2013.01); *F21V 14/06* (2013.01); *F21V 29/70* (2015.01); *F21Y 2103/10* (2016.08); *F21Y 2107/50* (2016.08); *F21Y 2115/10* (2016.08)

(58) Field of Classification Search
None
See application file for complete search history.

(56) References Cited

U.S. PATENT DOCUMENTS

| | | | | |
|---|---|---|---|---|
| 2011/0305024 | A1* | 12/2011 | Chang | F21V 3/049 362/294 |
| 2012/0106144 | A1* | 5/2012 | Chang | F21K 9/69 362/218 |
| 2013/0107537 | A1* | 5/2013 | Lee | F21K 9/275 362/283 |
| 2014/0029246 | A1* | 1/2014 | Umeda | F21K 9/68 362/217.05 |
| 2016/0356433 | A1* | 12/2016 | Xu | F21V 21/00 |
| 2017/0089530 | A1* | 3/2017 | Jiang | H05B 45/00 |
| 2020/0248893 | A1* | 8/2020 | Jeon | F21K 9/65 |

* cited by examiner

*Primary Examiner* — Elmito Breval
(74) *Attorney, Agent, or Firm* — Chun-Ming Shih; Lanway IPR Services

(57) ABSTRACT

A LED light tube includes a LED strip with a substrate plate and multiple LED modules. A light passing tube stores the LED strip. The light passing tube has a first portion and a second portion. The first portion has more light passing through than the second portion. A first end cap is attached to a first end of the light passing tube and a second end cap is attached to a second end of the light passing tube. The first end cap and the second end cap each having two pins. A driver is enclosed in one of the end caps for supplying a driving current to the multiple LED modules and controls the multiple LED modules.

18 Claims, 11 Drawing Sheets

LED LIGHT TUBE

FIELD

The present invention is related to a lighting fixture and more particularly related to a LED light tube.

BACKGROUND

The limited supply of fossil fuels has generated a great deal of research and engineering work in the area of alternative fuel and energy sources. Additionally, air pollution from the combustion of fossil fuels is another area of great interest. Many concerns are related to many of the things that we have done. There is an area receiving particular attention. The area reducing energy consumption used by illumination sources. Fluorescent strip light fixtures have been the main lighting in offices, schools, and similar locations for many years. A fluorescent strip light fixture is typically a long, rectangular light fixture that fits into a ceiling grid. The fluorescent strip light fixtures are often surface mounted boxes, but they may also be implemented recessed into the ceiling grid. The fluorescent strip light fixtures were originally designed for use with standard fluorescent lamps of their widespread acceptance, modular benefits, low cost and ease of installing and maintaining which have led them to be used with integral LED sources.

A fluorescent strip light fixtures represent a major improvement over incandescent lighting. However, a high efficiency LED lighting is now a new choice. Today LED lighting technology is rapidly replacing traditional incandescent and fluorescent lights. Even in the tube lighting applications, instead of being filled with inert gas and mercury as found in fluorescent tube lights, the LED tube lights are mercury-free. Thus, it is no surprise that LED tube lights are becoming highly desired illumination option among different available lighting systems used in homes and workplace, which used to be dominated by traditional lighting options such as compact fluorescent light bulbs and fluorescent tube lights. Benefits of the LED tube lights include improved durability and longevity, and far less energy consumption, therefore, when taking into of all factors, they may be considered as cost effective lighting option.

The LED tube lights are more often being used in offices, schools, homes, and similar locations. The LED tube lights with different or multiple functional devices providing lighting to light in the angle and the objects we required may be more efficient nowadays for people. Therefore, if we may design a product to meet the need of the human life and increase the life experience, the product may be able to bring considerable value and contribution to the society.

SUMMARY

A LED tube is usually produced using a large number of low or medium-power LEDs. With the help of using a large number or low or medium-power LEDs, light output and heat conduction are balanced out across the entire tube length. The operating temperature of the LED tube is lower as compared to traditional lighting technologies, and a LED tube produces less heat than traditional fluorescent lamps. A LED tube may be used for general purposes at all locations, with the exception of location where both upwards and downwards lighting is required. These include office luminaires suspended from the ceiling and emitting light upwards and downwards.

A LED light tube includes a LED strip. The LED strip has a substrate plate and multiple LED modules on the substrate plate. A light passing tube stores the LED strip. The light passing tube has a first portion and a second portion. The first portion has more light passing through than the second portion. A first end cap is attached to a first end of the light passing tube and a second end cap is attached to a second end of the light passing tube. The first end cap and the second end cap each having two pins. A driver is enclosed in one of the end caps for supplying a driving current to the multiple LED modules and controls the multiple LED modules.

In an embodiment, the LED light tube includes a rotating ring. The rotating ring is on the end cap of the light passing tube. A user may turn the rotating ring, and when they turn the rotating ring, they may change an area ratio of the first portion to the second portion through a turning action. The first portion may let more light passing through while the second portion allows less light passing through.

In an embodiment, the LED light tube has a rotating ring connected to an expandable shield. The expandable shield moves with the rotating ring in order to change between the area ratio of the first portion and the second portion. An inner side of the expandable shield has a reflective layer. The reflective layer may be form on the shield to reflect light. The reflective layer may be formed with highly reflective materials. A highly reflective coating layer may be coated on the inner side of the expandable shield, and a highly reflective strip may be stacked on the inner side of the expandable shield to provide a reflection. The expandable shield is made of a heat dissipation material.

In an embodiment, the LED light tube has the rotating ring connected to a lens structure. A user turns the rotating ring to switch to a relative position between the lens structure and the LED strip. The lens structure has at least a first lens with a first light beaming angle and a second lens with a second light beaming angle. Most lenses are spherical lenses. The two surfaces are parts of the surfaces of spheres. Each surface can be convex (bulging outwards from the lens), concave (depressed into the lens), or planar (flat). The line joining the centers of the spheres making up the lens surface is called the axis of the lens. Typically, the lens axis passes through the physical center of the lens, basing on the way they are manufactured. Lens may be cut or ground after manufacturing to be given a different shape or size. The lens axis may then not pass through the physical center of the lens.

In an embodiment, the LED light tube has a rotating ring. The rotating ring may switch to a relative position relating to the first portion and the LED strip, and the second portion and the LED strip. The rotating ring moving the LED strip to change a relative angle relating to the first end cap and the second end cap. The relative angle of the light makes the light irradiate from a direction to light up an object more precisely.

In an embodiment, the LED light tube has the rotating ring changed a parameter of the driver to change a driving pattern of the multiple LED modules. The multiple LED modules are divided into at least a first set and a second set facing a different direction. The driver selectively turns to the first set or the second set according to a rotation angle of the rotating ring.

In an embodiment, the LED light tube has the multiple LED modules divided into at least a third set and a fourth set. The third set of the multiple LED modules is covered with the lens structure. The driver selectively turns on the third set or the fourth set according to a rotation angle of the rotating ring.

In an embodiment, the LED light tube has a rotating ring connected to a color shield. The color shield covers on the first portion. When the rotating ring rotates, the color shield rotates with the rotating ring. The color shield may provide a medium for changing light colors by switching color shield. The color shield may be in several colors and may have not just one shield.

In an embodiment, the LED light tube has a driver. The driver has a table for storing multiple settings for driving the multiple LED modules. Each of the settings corresponding to a different color temperature optimized for illuminating an associated type of object. The rotating ring is rotated for setting the driver to select a corresponding setting for controlling the multiple LED modules.

In an embodiment, the LED light tube has the driver having a first driver circuit for converting an in-house power to drive the multiple LED modules and a second driver circuit for converting a ballast power generated by a ballast when the ballast is receiving the in-house power. The rotating ring switches to the first driver circuit or the second driver circuit to activate.

In an embodiment, the LED light tube has the driver. The driver has a wireless module for receiving an external command of a remote control. The driver controls the multiple LED modules according to the external command. A rotation angle of the rotating ring has a data setting device converting data sent from the remote control.

In an embodiment, the LED light tube has the driver having a wireless module for receiving an external command of a remote control. The driver controls the multiple LED modules according to the external command. A rotation angle of the rotating ring is used for interpreting the external command to the driver.

In an embodiment, the LED light tube includes a switch with a moving portion being exposed outside the first end cap and the second end cap. The switch being connected to the substrate plate for a user manually moving the moving portion to change a distance between the substrate plate and an inner surface of the light passing tube for changing an area ratio between the first portion and the second portion.

In an embodiment, the LED light tube has a first portion. The first portion has a lens structure for condensing a light to a light beam and the second portion has a diffusion layer for diffusing the light to a divergent light. The light beam may make a focus on an object the light irradiating. The divergent light provides a tender light to irradiate the object or also the surrounding place of the object.

In an embodiment, an area ratio between the first portion and the second portion is less than ⅓ for a light to pass. A transparency between the first portion and the second portion is allowed the light to irradiate less than 120 degree.

It should be noted that, the following description of various embodiments of the present disclosure is described herein in order to clearly illustrate the inventive features of the present disclosure. However, it is not intended that various embodiments can only be implemented alone and rather it is contemplated that various of the different embodiments can be and are intended to be used together in a final product and can be combined in various ways to achieve various final products. Thus, people having ordinary skill in the art may combine the possible embodiments together or replace the components/modules between the different embodiments according to requirements. The embodiments herein are not limit to the form described in the following descriptions, any possible replacement and arrangement between the various embodiments are included.

DETAILED DESCRIPTION

Figure 1:
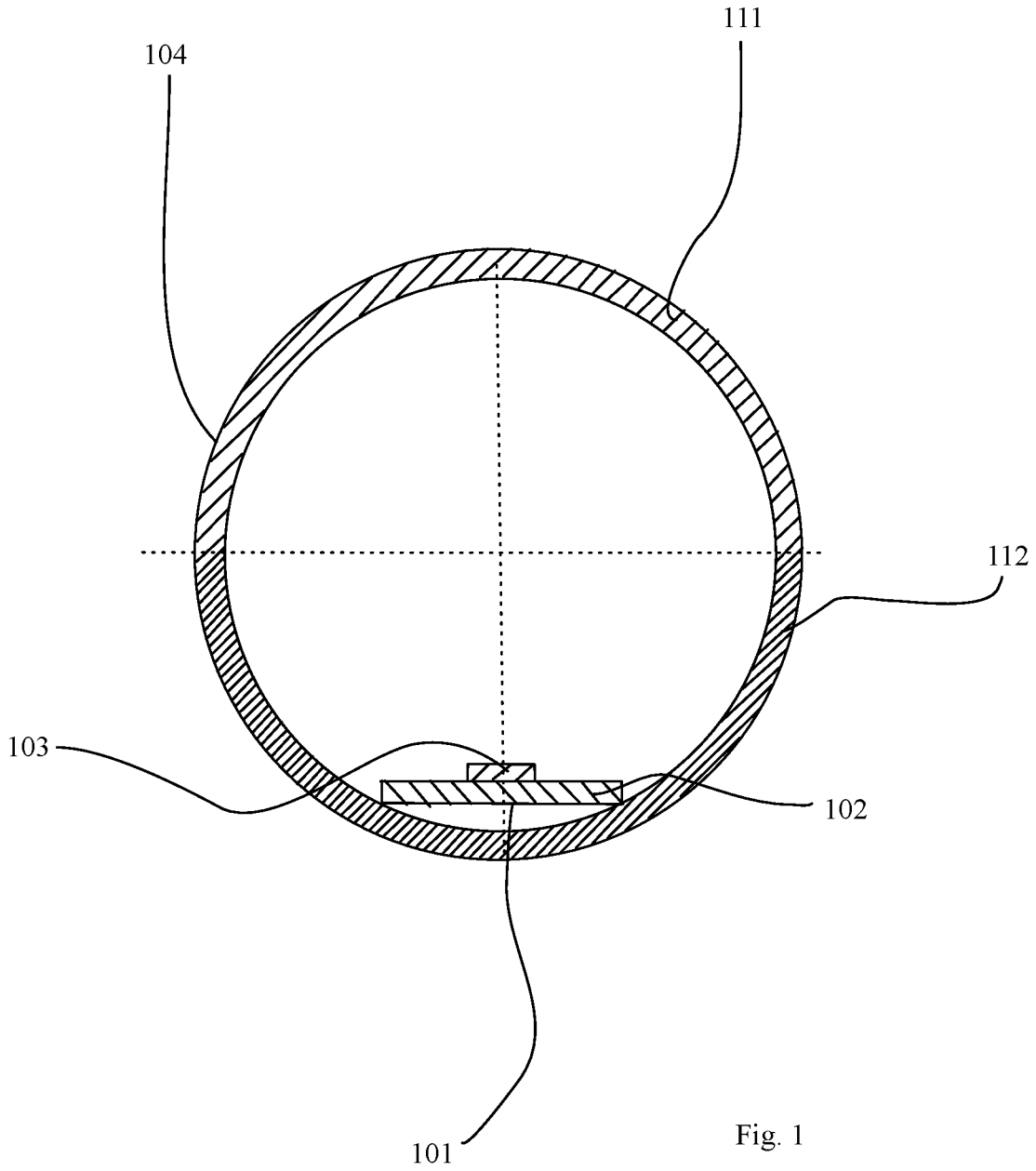
FIG. 1 is a cross-sectional view of a light passing tube with a first portion and a second portion according to a present disclosure.

Reference may now be made in detail to particular embodiments of the disclosure, examples of which are illustrated in the accompanying drawings. While the disclosure may be described in conjunction with the preferred embodiments, it may be understood that they may not intended to the limit the disclosure to these embodiments. On the contrary, the invention is intended to cover alternatives, modifications and equivalents that may be included within the spirit and scope of the disclosure as defined by the appended claims.

Furthermore, in the following detailed description of the present disclosure, numerous specific details are set forth in order provide a thorough understanding of the present disclosure. However, it may be readily apparent to one skilled in the art that the present disclosure may be practiced without these specific details. In other instances, well-known methods, procedures, processes, components, structures, and circuits have not been described in detail so as not to unnecessarily obscure aspects of the present disclosure.

In the drawings, the size and relative sizes of layers and regions may be exaggerated for clarity. Like numbers refer to like elements throughout. Though different figures show variations of exemplary embodiments, these figures are not necessarily intended to be mutually exclusive from each other. Rather, as will be seen from the context of the detailed description below, certain features depicted and described in different figures can be combined with other features from other figures to result in various embodiments, when taking the figures and their description as a whole.

Embodiments described herein will be described referring to plan views and/or cross-sectional views by way of ideal schematic views. Accordingly, the exemplary views may be modified depending on manufacturing technologies and/or tolerances. Therefore, the disclosed embodiments are not limited to those shown in the views but include modifications in configuration formed on the basis of manufacturing processes. Therefore, regions exemplified in figures may have schematic properties, and shapes of regions shown in figures may exemplify specific shapes of regions of elements to which aspects of the invention are not limited.

FIG. 1 is a cross-sectional view of a light passing tube with a first portion and a second portion according to a present disclosure. Referring to FIG. 1, a LED light tube includes a LED strip 101. The LED strip 101 has a substrate plate 102 and multiple LED modules 103 on the substrate plate 102. A light passing tube 104 stores the LED strip 101. The light passing tube 104 has a first portion 111 and a second portion 112. The first portion 111 has more light passing through than the second portion 112.

Figure 2:
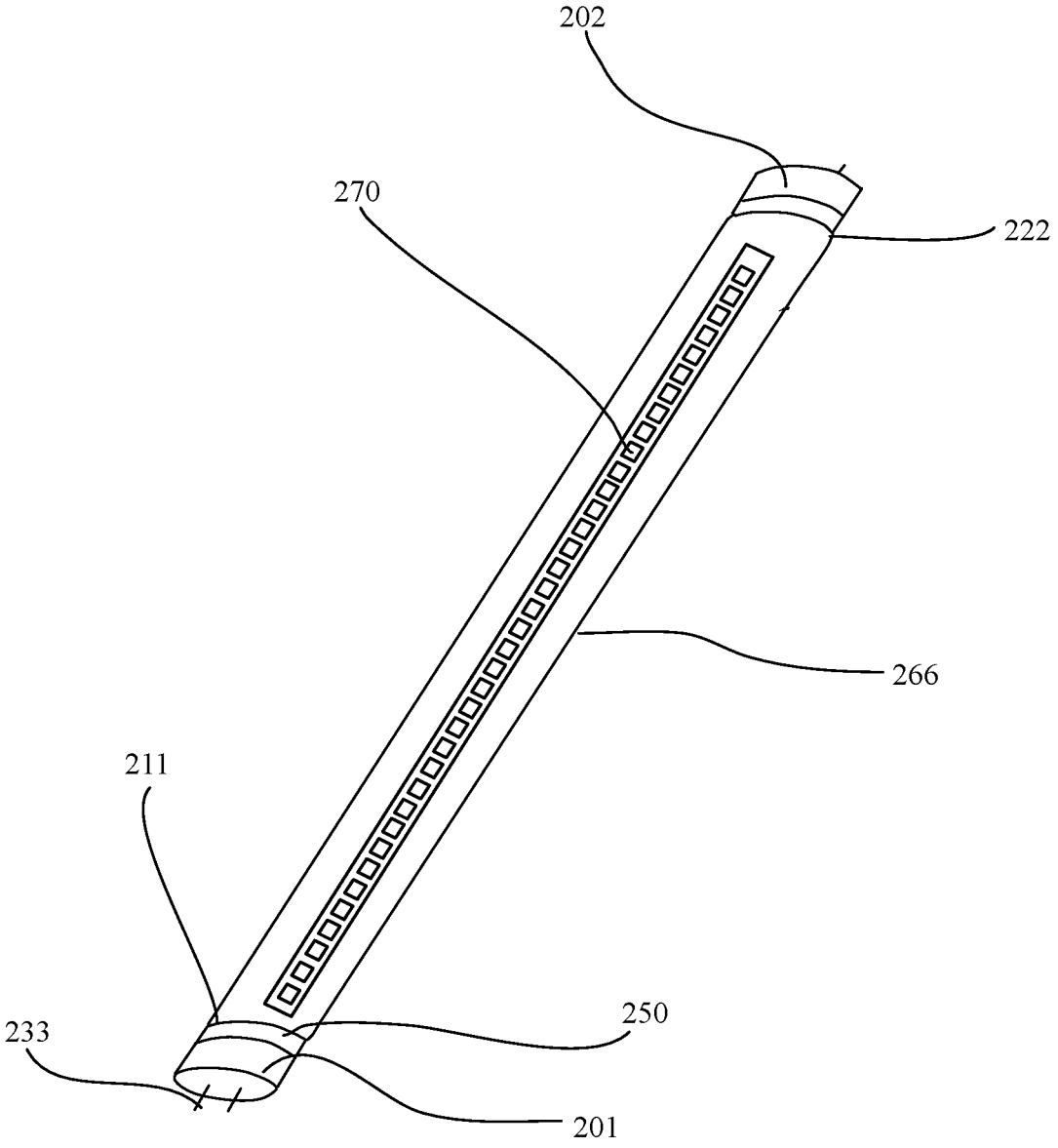
FIG. 2 is a perspective view of a LED light tube according to an embodiment of a present disclosure.

FIG. 2 is a perspective view of a LED light tube according to an embodiment of a present disclosure. Referring to FIG. 2, a first end cap 201 is attached to a first end 211 of the light passing tube 266 and a second end cap 202 is attached to a second end 222 of the light passing tube 266. The first end cap 201 and the second end cap 202 each having two pins 233. A driver 250 is enclosed in one of the end caps for supplying a driving current to the multiple LED modules 270 and controls the multiple LED modules 270.

Figure 3:
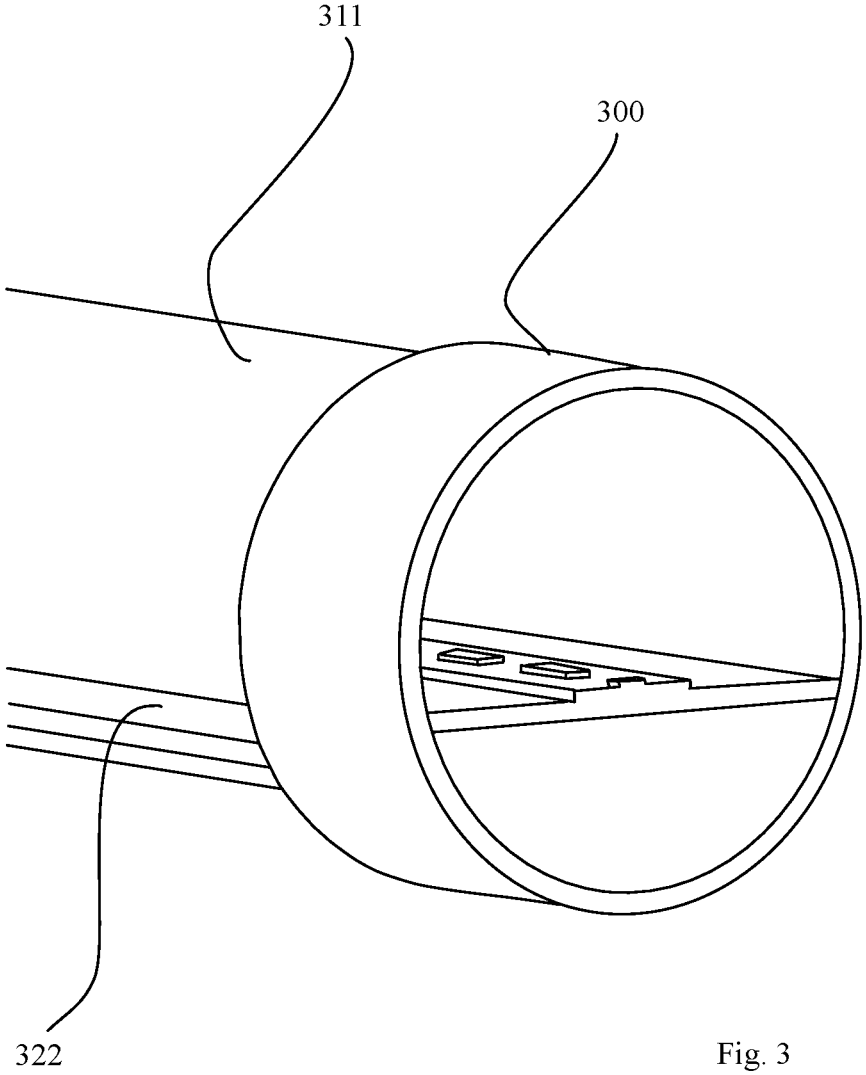
FIG. 3 is a schematic diagram of a LED light tube according to an embodiment of a present disclosure.

FIG. 3 is a schematic diagram of a LED light tube according to an embodiment of a present disclosure. Referring to FIG. 3, the LED light tube includes a rotating ring 300. The rotating ring 300 is on the end cap of the light passing tube. A user may turn the rotating ring 300, and when they turn the rotating ring 300, they may change an area ratio 311 of the first portion to the second portion through a turning action. The first portion may let more light passing through while the second portion allows less light passing through.

In an embodiment, a light passing tube has a shape of an elongated cylinder, which is a straight structure. However, the light passing tube can take any curved structure such as a ring or a horseshoe. The cross section of the light tube defines, typically, a circle, or not as typically, an ellipse or a polygon. Alternatively, the cross section of the light tube takes an irregular shape depending on the shapes of, respectively, the light transmissive portion and the reinforcing portion and on the manner the two portions interconnect to form the light tube. The light passing tube is a glass tube, a plastic tube or a tube made of any other suitable material or combination of materials. In some embodiments, a plastic light tube is made from light transmissive plastic, thermally conductive plastic or a combination of both. The light transmissive plastic may be one of translucent polymer matrices such as polymethyl methacrylate, polycarbonate, polystyrene, poly (styrene-co-methyl methacrylate) and a mixture thereof. In some embodiments, the strength and elasticity of thermally conductive plastic is enhanced by bonding a plastic matrix with glass fibers. In an embodiment, an outer shell of light tube includes a plurality of layers made from distinct materials. For example, the light tube may include a plastic tube coaxially sheathed by a glass tube.

Figure 4:
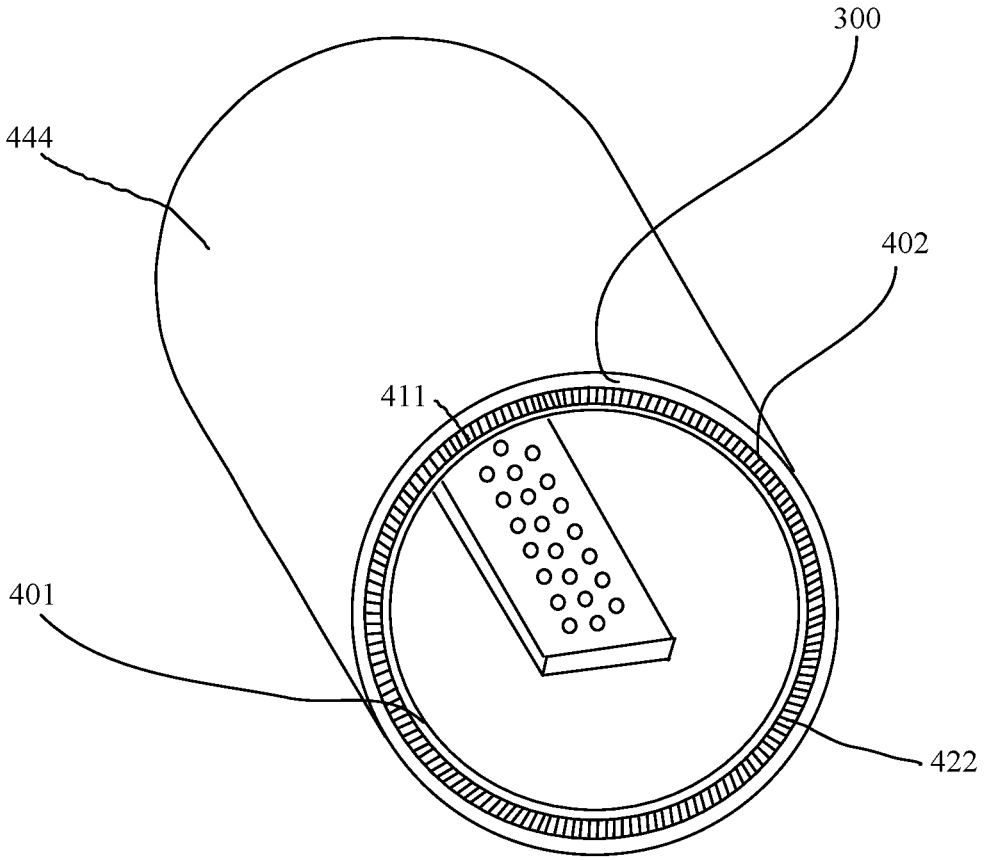
FIG. 4 illustrates a schematic view of a LED light tube according to an embodiment of a present disclosure.

FIG. 4 illustrates a schematic view of a LED light tube according to an embodiment of a present disclosure.

Referring to FIG. 3 and FIG. 4, the LED light tube has a rotating ring connected to an expandable shield 322. The expandable shield 322 moves with the rotating ring 300 in order to change between the area ratio 311 of the first portion and the second portion. An inner side of the expandable shield 322 has a reflective layer 401. The reflective layer 401 may be form on the expendable shield 322 to reflect light. The reflective layer 401 may be formed with highly reflective materials. A highly reflective coating layer may be coated on the inner side of the expandable shield 322, and a highly reflective strip may be stacked on the inner side of the expandable shield 322 to provide reflection. The expandable shield 322 is made of a heat dissipation material.

Referring to FIG. 4, the LED light tube has the rotating ring 300 connected to a lens structure 402. A user turns the rotating ring 300 to switch to a relative position between the lens structure and the LED strip. The lens structure 402 has at least a first lens 411 with a first light beaming angle and a second lens 422 with a second light beaming angle. Most lenses am spherical lenses. The two surfaces are parts of the surfaces of spheres. Each surface can be convex (bulging outwards from the lens), concave (depressed into the lens), or planar (flat). The line joining the centers of the spheres making up the lens surface is called the axis of the lens. Typically, the lens axis passes through the physical center of the lens, basing on the way they are manufactured. Lens may be cut or ground after manufacturing to be given a different shape or size. The lens axis may then not pass through the physical center of the lens.

In an embodiment, the LED light tube has a rotating ring. The rotating ring may switch to a relative position relating to the first portion and the LED strip, and the second portion and the LED strip. The position of the light strip inside the light passing tube is chosen in light of a desired totality of factors such as field angle, heat dissipation capability and structural strength. The distance between the light strip and the dome of the light passing tube to the diameter of the light passing tube may be from zero point twenty five to zero point nine. In some embodiments, the distance between the light strip and the dome of the light passing tube to the diameter of the light passing tube may be from zero point thirty three to zero point seventy five.

In an embodiment, the LED light tube has the rotating ring moving the LED strip to change a relative angle relating to the first end cap and the second end cap. Beam angle indicates the spread of light from the light source. A narrow beam gives a concentrated light which is better for accent lighting. A wide beam gives a more general, softer light. Every light source from an LED to a simple wax candle has got a beam angle. A beam angle is a measurement of how the light is distributed. GU-ten LEDs and recessed downlights have a fairly narrow beam of around forty degrees, anything within five degrees of this is the industry standard. A wax candle ortraditionallight bulb would have a beam angle of three hundred and sixty degrees as the light shines all the way around but is less intense. The brightness, measured in lumens, remains the same but the beam intensity, measured in candelas, increases. The downside to a wider beam angle is that it is not as intense and the center of the beam of light may not go as far. A narrow beam angle of twenty-five degrees is known as a spot. Wider beam angles of sixty degrees are known as flood and even wider beams are known as wide flood beams. One of the best examples of using a wider beam such as sixty degrees would be in a lounge area. Lounges do not need to be as bright as other rooms and are usually illuminated to around one hundred and fifty lux as you are only performing basic tasks like watching the TV or reading. In comparison a kitchen may be around three hundred lux as you need to see what you are doing more clearly. By using a wider beaming angle light may space out downlights further apart, rather than having the one meter apart you may go to one point two or one point five meter distances.

Figure 5:
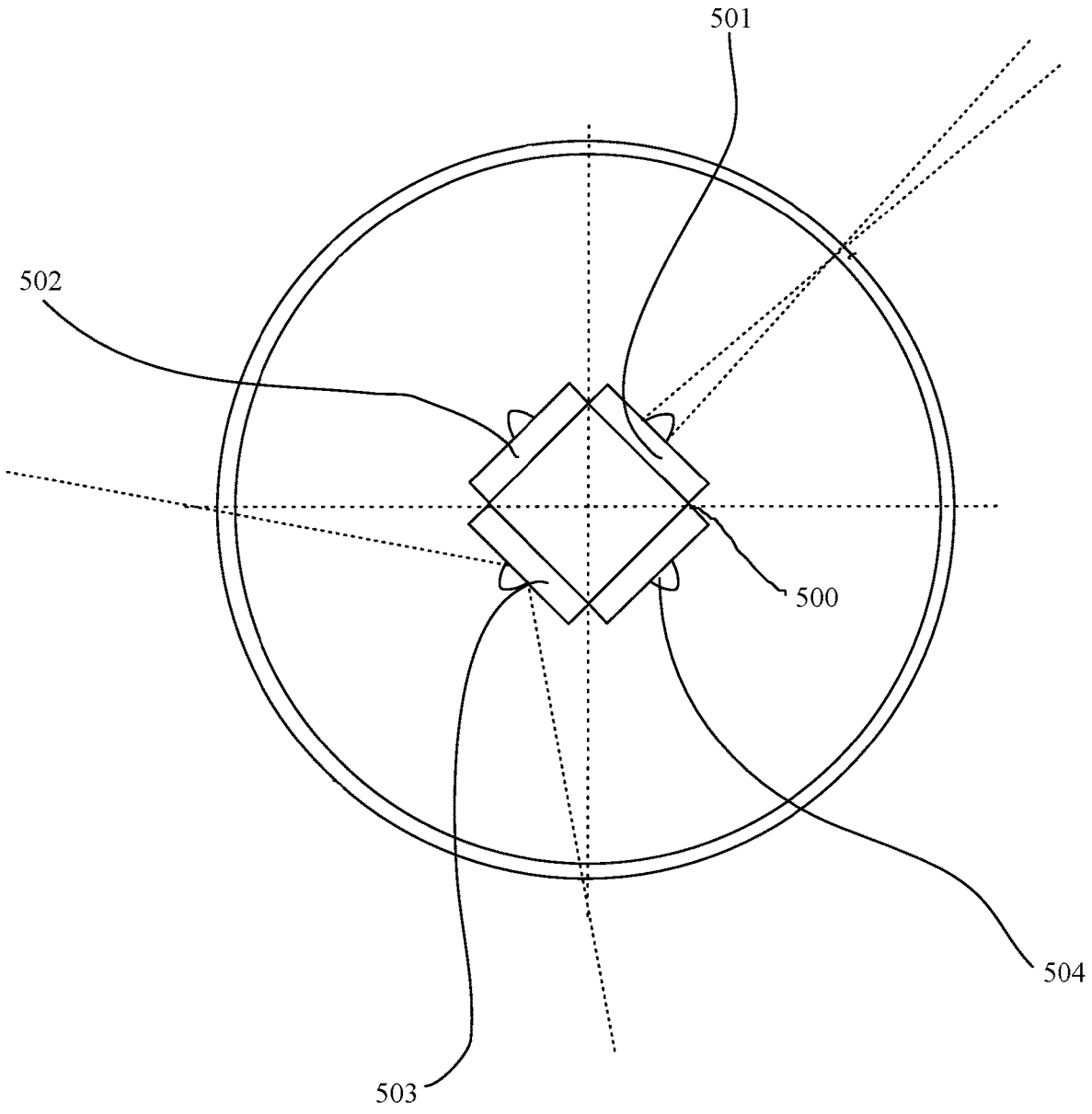
FIG. 5 is a cross-sectional perspective view a LED light tube according to an embodiment of a present disclosure.

FIG. 5 is a cross-sectional perspective view a LED light tube according to an embodiment of a present disclosure. Referring to FIG. 5, the LED light tube has the rotating ring changed a parameter of the driver to change a driving pattern of the multiple LED modules 500. The multiple LED modules 500 are divided into at least a first set 501 and a second set 502 facing a different direction. The driver selectively turns to the first set 501 or the second set 502 according to a rotation angle of the rotating ring.

Referring to FIG. 5, the LED light tube has the multiple LED modules 500 divided into at least a third set 503 and a fourth set 504. The third set 503 of the multiple LED modules 500 are covered with the lens structure. The driver selectively turns on the third set 503 or the fourth set 504 according to a rotation angle of the rotating ring.

Referring to FIG. 4, the LED light tube has the rotating ring 300 connected to a color shield 444. The color shield 444 covers on the first portion. When the rotating ring 300 rotates, the color shield 444 rotates with the rotating ring 300. The color shield 444 may provide a medium for changing light colors by switching color shield 444. The color shield 444 may be in several colors and may have not just one shield.

Figure 6:
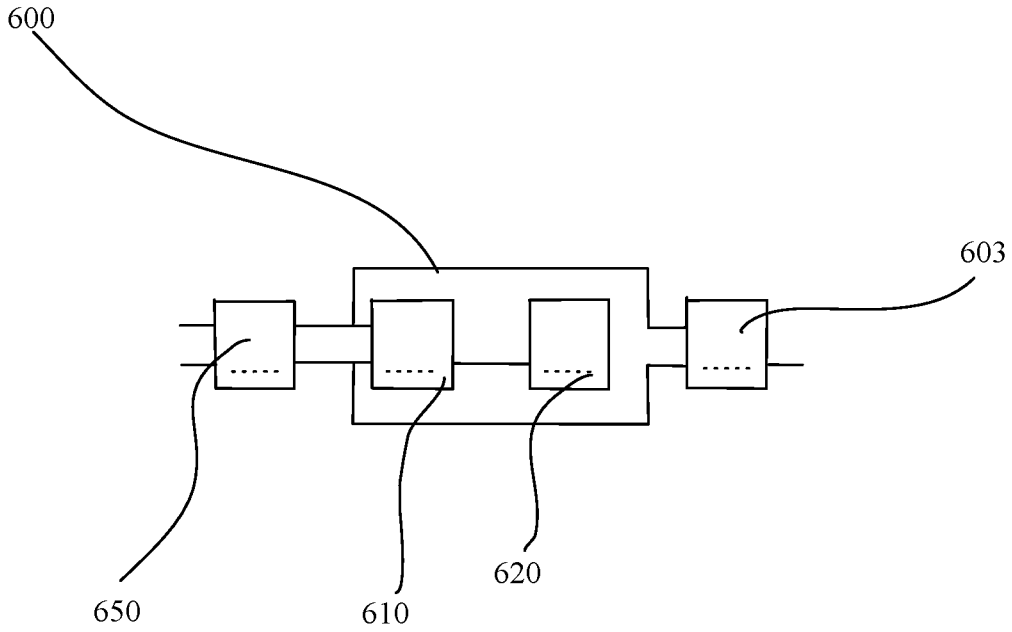
FIG. 6 illustrates a block diagram an exemplary driver in a LED light tube according to some embodiments.

FIG. 6 illustrates a block diagram an exemplary driver in a LED light tube according to some embodiments. Referring to FIG. 6, the LED light tube has a driver 600. The driver 600 has a table for storing multiple settings for driving the multiple LED modules. Each of the settings corresponding to a different color temperature optimized for illuminating an associated type of object. The color of light can be quantified by referring to its color temperature. White light is measured in Kelvins (K). Most white lights fall in a spectrum between 1800K and 6500K. When getting close to 3000K, the light is noticeably warmer. On the other end of the spectrum, the lights have a blue tint and cooler tone when nearing 6500K. The rotating ring is rotated for setting the driver to select a corresponding setting for controlling the multiple LED modules.

Referring to FIG. 6, the LED light tube has the driver 600 having a first driver circuit 610 for converting an in-house power to drive the multiple LED modules and a second driver circuit 620 for converting a ballast 603 power generated by a ballast 603 when the ballast 603 is receiving the in-house power. The rotating ring switches to the first driver circuit 610 or the second driver circuit 620 to activate.

Referring to FIG. 6, the LED light tube has the driver 600. The driver 600 has a wireless module 650 for receiving an external command of a remote control. The driver 600 controls the multiple LED modules according to the external command. A rotation angle of the rotating ring has a data setting device converting data sent from the remote control.

Referring to FIG. 6, the LED light tube has the driver 600 having the wireless module 650 for receiving an external command of a remote control. The driver 600 controls the multiple LED modules according to the external command. A rotation angle of the rotating ring is used for interpreting the external command to the driver 600.

An AC power supply is used to supply an AC supply signal and may be an AC powerline with a voltage rating, for example, from to volts and a frequency rating, for example, of fifty or sixty Hz. A light driving circuit receives and then converts the AC supply signal into an AC driving signal as an external driving signal. The light driving circuit may be for example an electronic ballast used to convert the AC powerline into a high-frequency high-voltage AC driving signal. Common types of electronic ballast include instant-start ballast, program-start or rapid-start ballast, etc., which may all be applicable to the LED light tube. The voltage of the AC driving signal is likely to be higher than volts and is in some embodiments in the range of from to volts. The frequency of the AC driving signal may be higher than ten k Hz. In some embodiments, the frequency of the AC driving signal may be in the range of from twenty k to fifty k Hz. The LED light tube receives an external driving signal and is thus driven to emit light. In one embodiment, the external driving signal comprises the AC driving signal from light driving circuit. In one embodiment, LED light tube is in a driving environment in which it is power supplied at its one end cap having two conductive pins, which are coupled to light driving circuit to receive the AC driving signal. The two conductive pins and may be electrically connected to, either directly or indirectly, the light driving circuit.

It is worth noting that light driving circuit may be omitted and is therefore depicted by a dotted line. In one embodiment, if light driving circuit is omitted, AC power supply is directly connected to pins and, which then receive the AC supply signal as an external driving signal. In addition to the above use with a single-end power supply, LED tube light may instead be used with a dual-end power supply to one pin at each of the two ends of an LED light tube.

A power supply module of the LED light includes a rectifying circuit and a filtering circuit and may also include some components of an LED lighting module. Rectifying circuit is coupled to pins and to receive and then rectify an external driving signal, so as to output a rectified signal at output terminals. The external driving signal may be the AC driving signal, or the AC supply signal or may even be a DC signal. The nature of the external driving signal will not impact on the way the LED light is otherwise implemented. Filtering circuit is coupled to the first rectifying circuit for filtering the rectified signal to produce a filtered signal. For instance, filtering circuit is coupled to terminals and to receive and then filter the rectified signal, so as to output a filtered signal at output terminals. LED lighting module is coupled to filtering circuit, to receive the filtered signal for emitting light. For instance, LED lighting module may be a circuit coupled to terminals and to receive the filtered signal and thereby to drive an LED light source (not shown) in LED lighting module to emit light. Details of these operations are described in below descriptions of certain embodiments.

It is worth noting that although there are two output terminals and two output terminals in some embodiments, in practice the number of ports or terminals for coupling between rectifying circuit, filtering circuit, and LED lighting module may be one or more depending on the signal transmission between the circuits or devices.

In addition, the power supply module of the LED light and embodiments of the power supply module of an LED light described below, may each be used in the LED light tube, and may instead be used in any other type of LED lighting structure having two conductive pins used to conduct power, such as LED light bulbs, personal area lights (PAL), plug-in LED lights with different types of bases (such as types of PL-S, PL-D, PL-T, PL-L, etc.).

In an embodiment, an AC power supply is used to supply an AC supply signal. A light driving circuit receives and then converts the AC supply signal into an AC driving signal. An LED light tube receives an AC driving signal from light driving circuit and is thus driven to emit light. In this embodiment, LED light tube is power-supplied at its both end caps respectively having two pins and two pins, which are coupled to light driving circuit to concurrently receive the AC driving signal to drive an LED light source (not shown) in LED light tube to emit light. AC power supply may be the AC powerline, and light driving circuit may be a stabilizer or an electronic ballast.

In an embodiment, the power supply module of the LED light includes a rectifying circuit, a filtering circuit, and a rectifying circuit, and may also include some components of an LED lighting module. Rectifying circuit is coupled to pins and to receive then rectify an external driving signal conducted by pins. Rectifying circuit is coupled to pins and to receive then rectify an external driving signal conducted by pins. Therefore, the power supply module of the LED light may include two rectifying circuits and configured to output a rectified signal at output terminals. Filtering circuit is coupled to terminals and to receive and then filter the rectified signal, so as to generate a filtered signal at output terminals. LED lighting module is coupled to terminals and to receive the filtered signal and thereby to drive an LED light source (not shown) in LED lighting module to emit light.

The power supply module of the LED light of an embodiment may be used in LED light tube with a dual-end power supply. It is worth noting that since the power supply module of the LED light includes a rectifying circuit and the power supply module of the LED light may be used in LED light tube with a single-end power supply to receive an external driving signal (such as the AC supply signal or the AC driving signal described above). The power supply module of an LED light in this embodiment and other embodiments herein may also be used with a DC driving signal.

Figure 7:
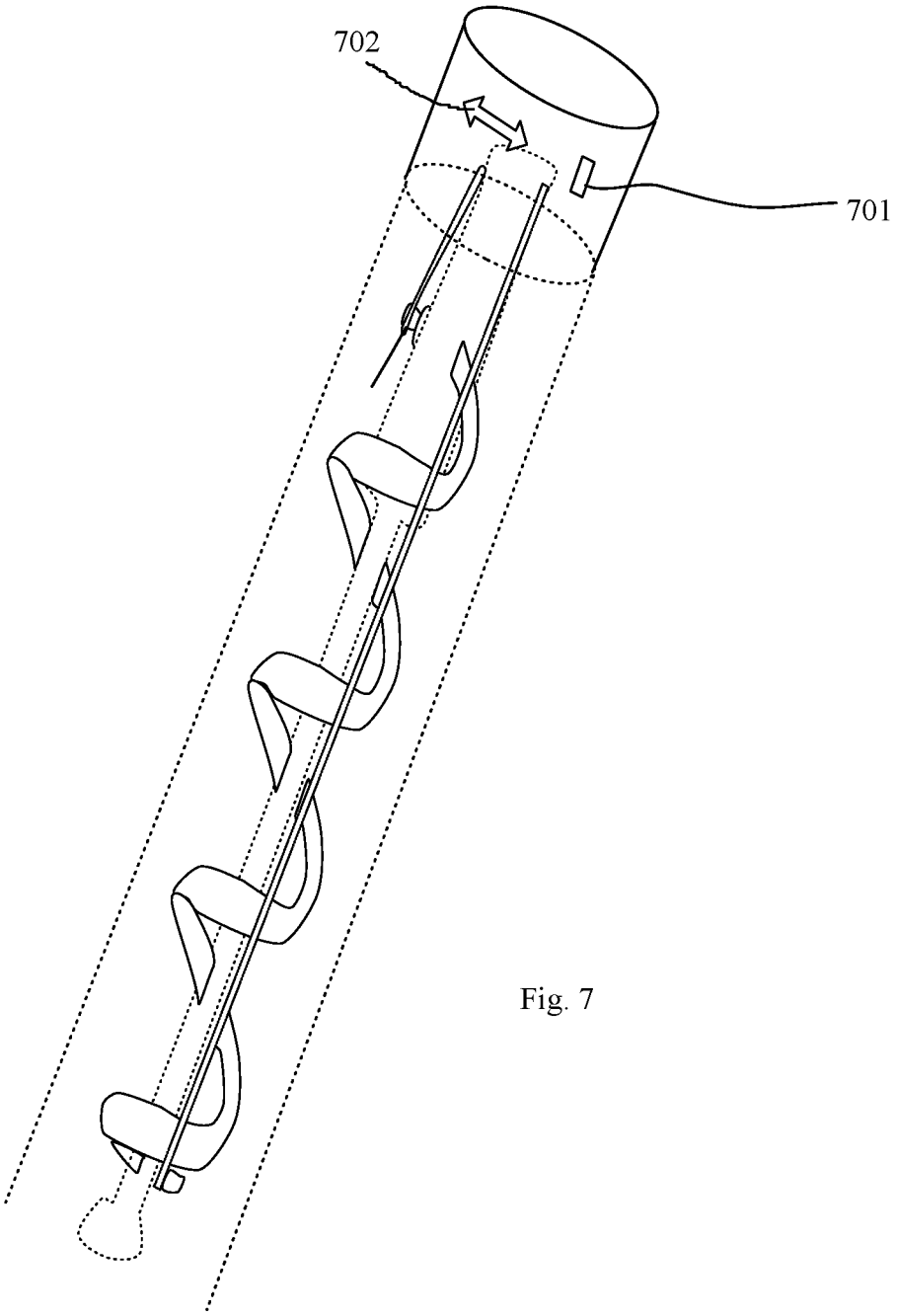
FIG. 7 is a side perspective view of a LED light tube according to an embodiment of a present disclosure.

Referring to FIG. 7, the LED light tube includes a switch 701 with a moving portion 702 being exposed outside the first end cap and the second end cap. The switch 701 being connected to the substrate plate for a user manually moving the moving portion 702 to change a distance between the substrate plate and an inner surface of the light passing tube for changing an area ratio between the first portion and the second portion.

Figure 8A:
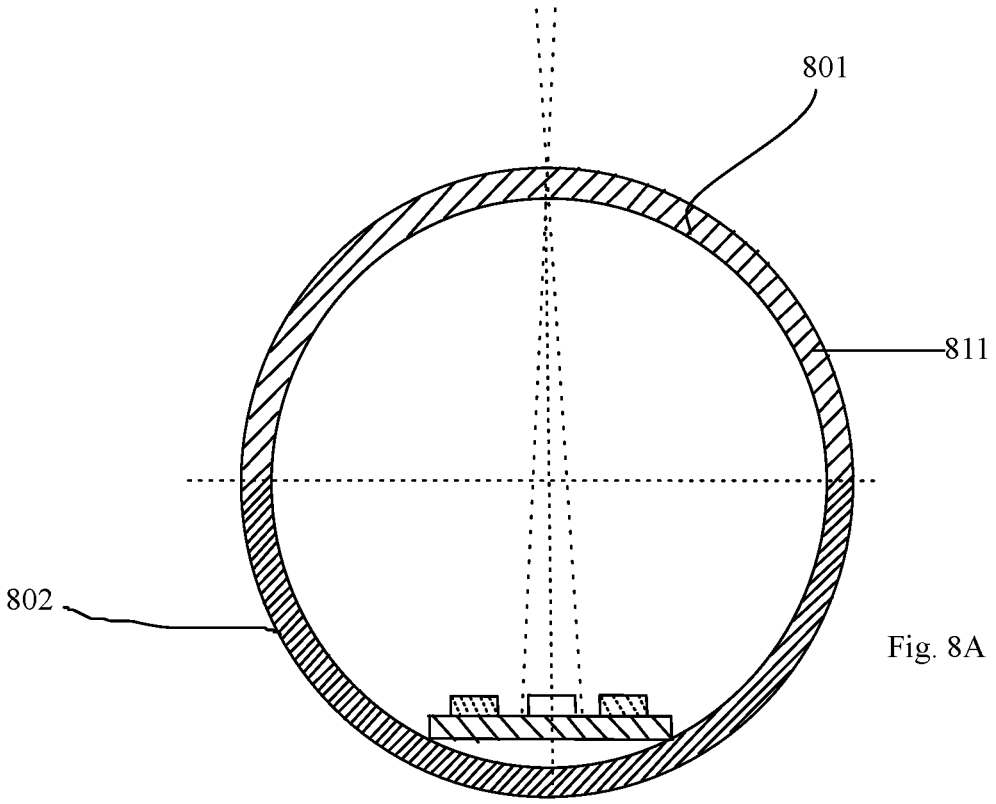
FIG. 8A is a cross-sectional view of a LED light tube according to an embodiment of a present disclosure.
Figure 8B:
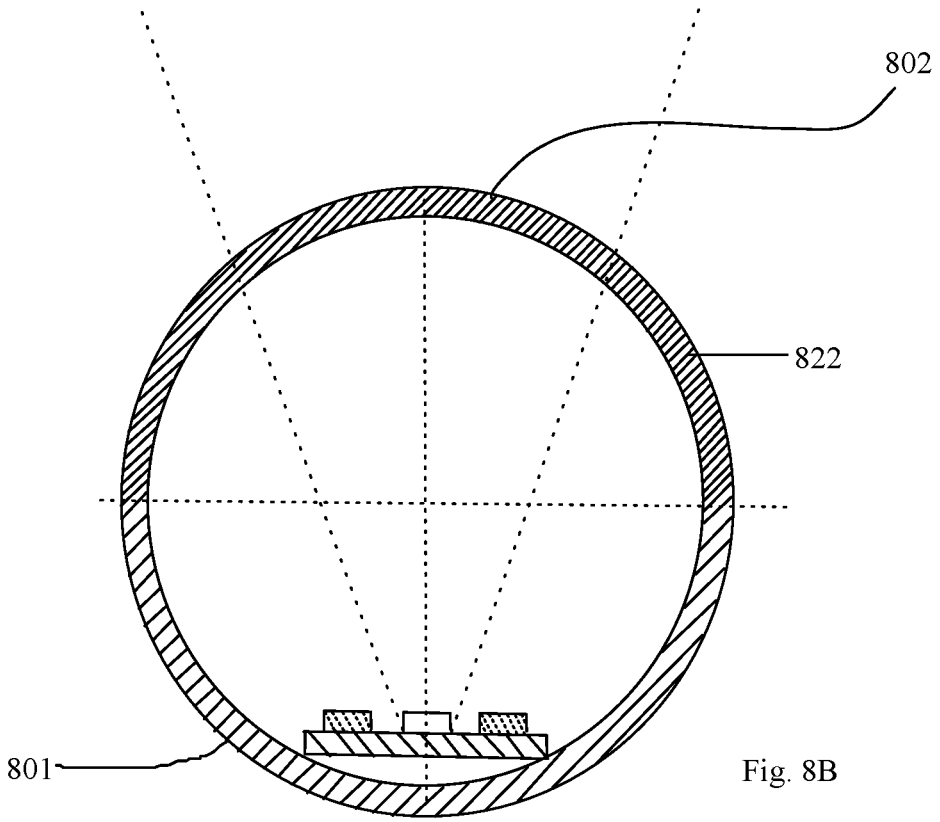
FIG. 8B is a cross-sectional view of a LED light tube according to an embodiment of a present disclosure.

Referring to FIGS. 8A and 8B, the LED light tube has a first portion 801. The first portion 801 has a lens structure 811 for condensing a light to a light beam. The second portion 802 has a diffusion layer 822 for diffusing the light to a divergent light. The light beam may make a focus on an object the light irradiating. The divergent light provides a tender light to irradiate the object or also the surrounding place of the object. An area ratio between the first portion 801 and the second portion 802 is less than ⅓ for a light to pass. A transparency between the first portion 801 and the second portion 802 is allowed the light to irradiate less than on hundred and twenty degrees.

Figure 9A:
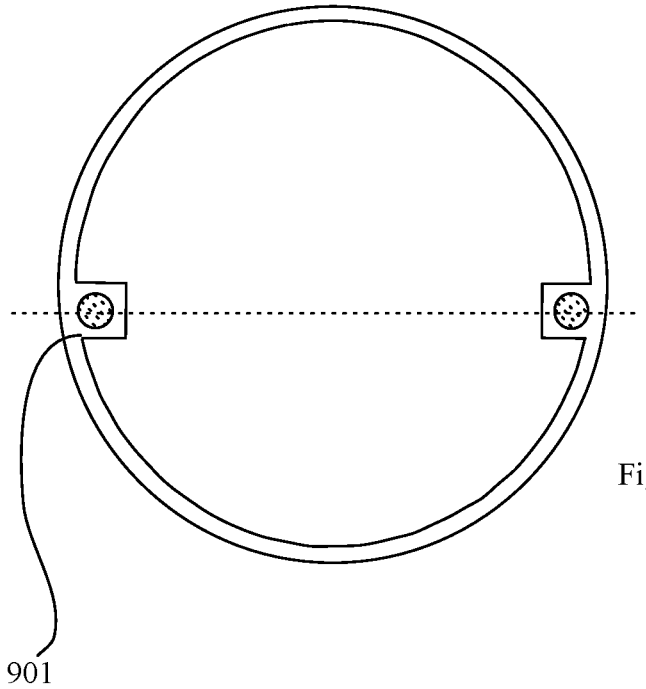
FIG. 9A illustrates a schematic view of a connection of a rotating ring according to an embodiment of a present disclosure.
Figure 9B:
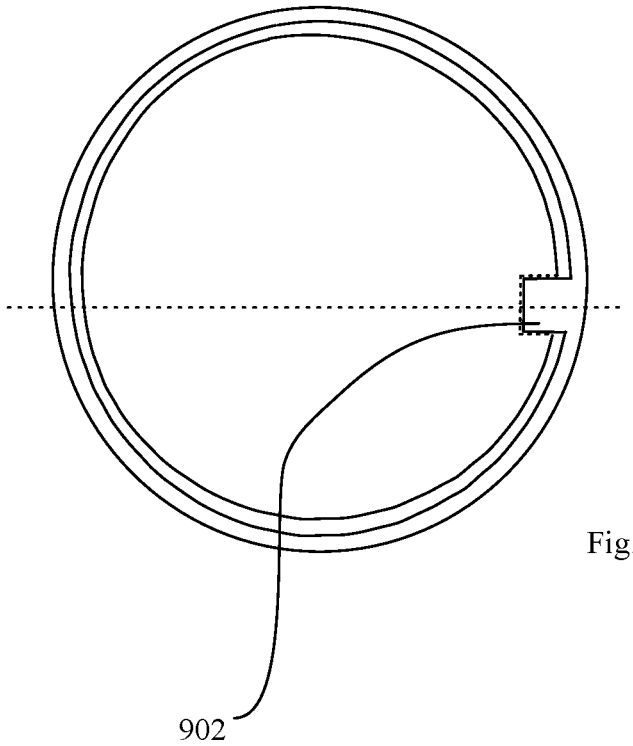
FIG. 9B illustrates a schematic view of a connection of a rotating ring according to an embodiment of a present disclosure.

FIG. 9A illustrates a schematic view of a connection of a rotating ring according to an embodiment of a present disclosure. FIG. 9B illustrates a schematic view of a connection of a rotating ring according to an embodiment of a present disclosure.

Referring to FIGS. 9A and 9B, a rotating ring may be attached to a light tube in several ways. The rotating ring may be connected to different functional devices for a user to choose the function they need, and then attach the rotating ring to the light tube they already have. The rotating ring may also be movable to attach to the light tube but also replaced by another rotating ring. A connection between the rotating ring and a light tube may be a magnetic portion 901. The connection between the rotating ring may also be a protruding portion 902 which may fit in a notch portion of an end of the light tube.

Figure 10A:
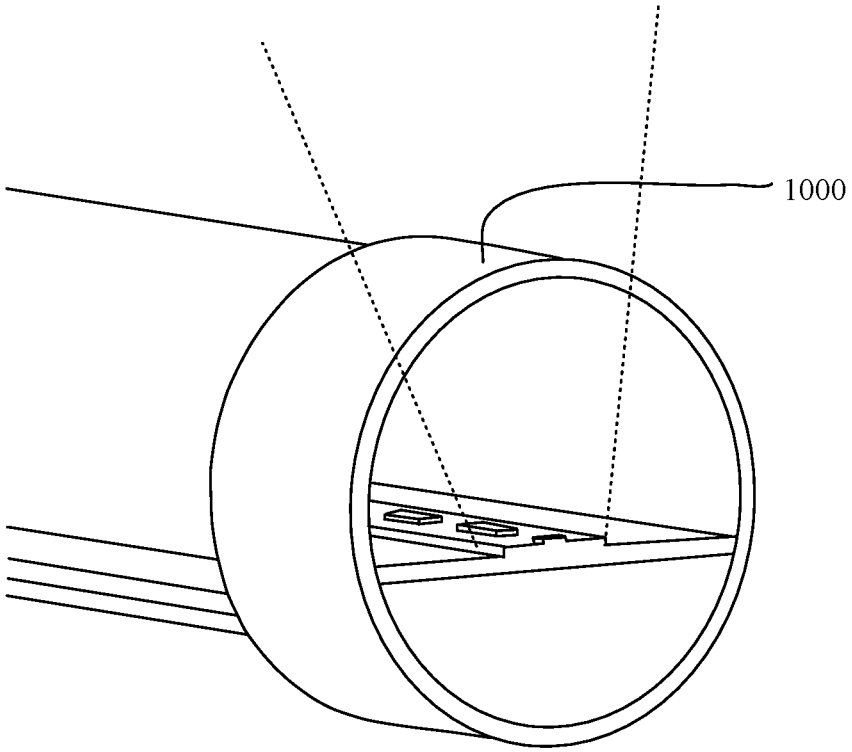
FIG. 10A side schematic view of a LED light tube according to an embodiment of a present disclosure.
Figure 10B:
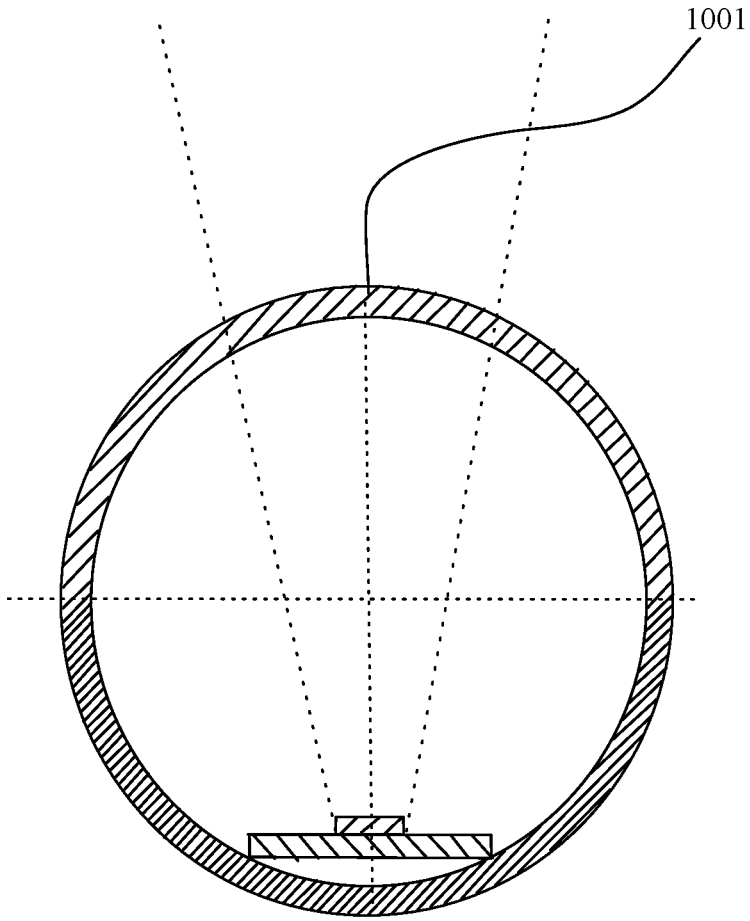
FIG. 10B cross-sectional view of a lighting angle according to an embodiment of a present disclosure.
Figure 11A:
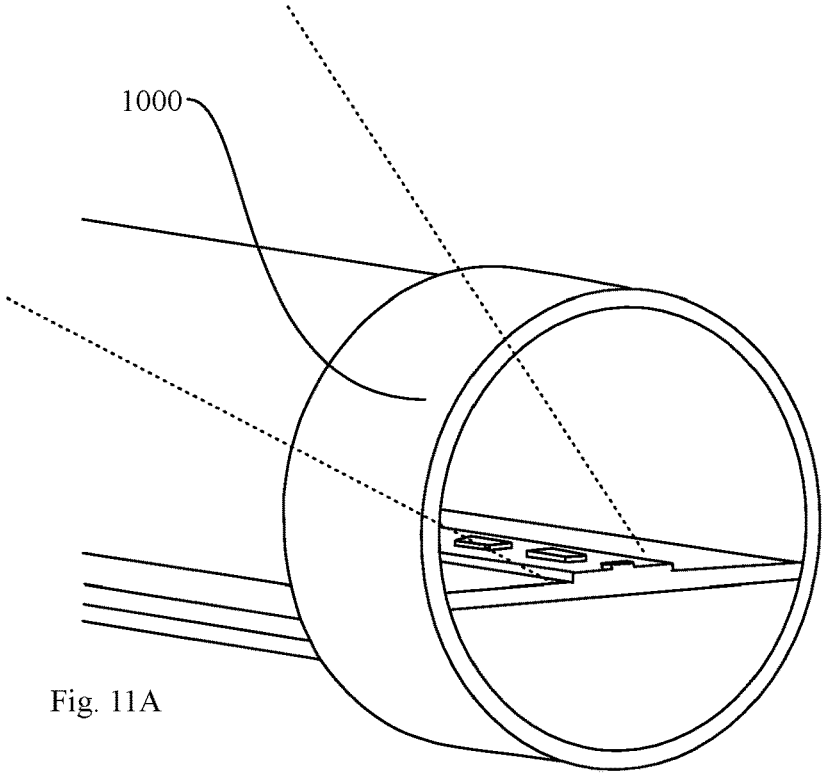
FIG. 11A side schematic view of a LED light tube according to an embodiment of a present disclosure.
Figure 11B:
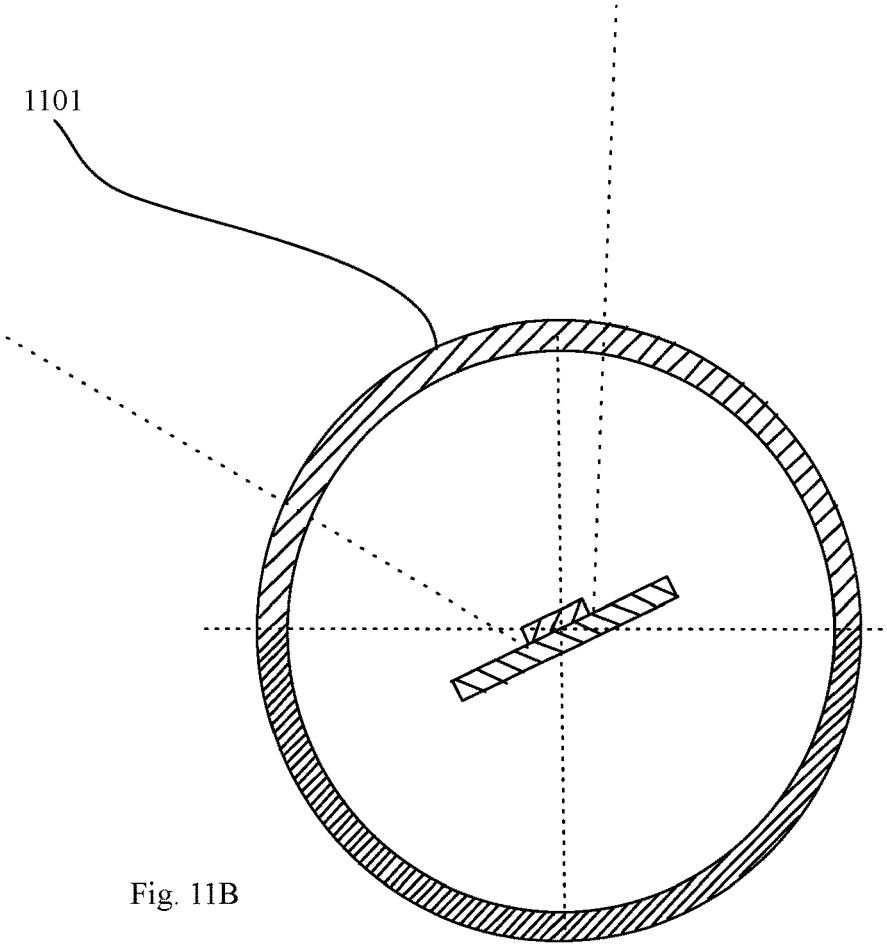
FIG. 11B cross-sectional view of a lighting angle according to an embodiment of a present disclosure.

FIG. 10A side schematic view of a LED light tube according to an embodiment of a present disclosure. FIG. 10B cross-sectional view of a lighting angle according to an embodiment of a present disclosure. FIG. 11A side schematic view of a LED light tube according to an embodiment of a present disclosure. FIG. 11B cross-sectional view of a lighting angle according to an embodiment of a present disclosure.

Referring to FIGS. 10A, 10B, 11A and 11B. A rotating ring 1000 may be rotated by a user to control the lighting angle of the light. The rotating ring is connected to the LED strip to change an arrangement and a direction of the LED strip for a suitable lighting angle. When the rotating ring 1000 is in a direction, a first lighting mode 1001 irradiates straight to the opposite side of the LED strip. When the rotating ring 1000 is rotated by a user, the LED strip may rotate in the same direction with the rotating ring 1000. The LED strip changes to a second lighting mode 1101 irradiates another direction different from the first lighting mode. In an embodiment, the rotating ring may rotate ten degrees, and the LED strip rotates ten degrees in the same direction with the rotating ring to light an object. The rotating ring may rotate fifty degrees, and the LED rotates fifty degrees in the same direction with the rotating ring to light the object.

In an embodiment, there are various kinds of products in a store, and different kinds of products may have different lighting mode for bringing out a better looking of the products. The rotating ring may have an installed tracking module to track which product the light tube is above to identify the light color the light has to provide. The installed tracking module may also be tracking the movement of a human. When the human is below the light tube, the tracking module gives a signal to the light tube to lighten up an area When there is no human below the light tube, the tracking module gives a signal to the light tube to not brighten up for saving electricity.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A LED light tube, comprising:

a LED strip having a substrate plate and multiple LED modules on the substrate plate;

a light passing tube for storing the LED strip, the light passing tube having a first portion and a second portion, the first portion having more light passing than the second portion;

a first end cap attaching to a first end of the light passing tube and a second end cap attaching to a second end of the light passing tube, the first end cap and the second end cap each having two pins;

a driver enclosing in one of the end caps for supplying a driving current to the multiple LED modules and for controlling the multiple LED modules; and a rotating ring manually rotatable by a user for changing an area ratio of the first portion to the second portion, wherein the rotating ring changes a parameter of the driver to change a driving pattern of the multiple LED modules.

2. The LED light tube of claim 1, wherein the rotating ring is connected to an expandable shield, the expandable shield moves with the rotating ring for changing the area ratio of the first portion and the second portion.

3. The LED light tube of claim 2, wherein an inner side of the expandable shield has a reflective layer.

4. The LED light tube of claim 2, wherein the expandable shield is made of a heat dissipation material.

5. The LED light tube of claim 1, wherein the rotating ring is connected to a lens structure for moving a relative position between the lens structure and the LED strip.

6. The LED light tube of claim 5, wherein the lens structure having a first lens with a first light beaming angle and a second lens with a second light beaming angle.

7. The LED light tube of claim 1, wherein the rotating ring changes a relative position relating to the first portion and the LED strip, and the second portion and the LED strip.

8. The LED light tube of claim 1, wherein the rotating ring moves the LED strip to change a relative angle relating to the first end cap and the second end cap.

9. The LED light tube of claim 1, wherein the multiple LED modules are divided into at least a first set and a second set facing a different direction, the driver selectively turns to the first set or the second set according to a rotation angle of the rotating ring.

10. The LED light tube of claim 1, wherein the multiple LED modules are divided into at least a third set and a fourth set, the third set of the multiple LED modules is covered with the lens structure, the driver selectively turns on the third set or the fourth set according to a rotation angle of the rotating ring.

11. The LED light tube of claim 1, wherein the rotating ring is connected to a color shield covering on the first portion and rotates when the rotating ring is rotated.

12. The LED light tube of claim 1, wherein the driver has a table storing multiple settings for driving the multiple LED modules, each of the settings corresponding to a different color temperature optimized for illuminating an associated type of object, the rotating ring is rotated for setting the driver to select a corresponding setting for controlling the multiple LED modules.

13. The LED light tube of claim 1, wherein the driver has a first driver circuit for converting an in-house power to drive the multiple LED modules and a second driver circuit for converting a ballast power generated by a ballast when the ballast is receiving the in-house power, the rotating ring switches to the first driver circuit or the second driver circuit to activate.

14. The LED light tube of claim 1, wherein the driver has a wireless module for receiving an external command of a remote control, the driver controls the multiple LED modules according to the external command, a rotation angle of the rotating ring has a data setting device converting data sent from the remote control.

15. The LED light tube of claim 1, wherein the driver has a wireless module for receiving an external command of a remote control, the driver controls the multiple LED modules according to the external command, a rotation angle of the rotating ring is used for interpreting the external command to the driver.

16. The LED light tube of claim 1, further comprising a switch with a moving portion being exposed outside the first end cap and the second end cap, the switch being connected to the substrate plate for a user manually moving the moving portion to change a distance between the substrate plate and an inner surface of the light passing tube for changing an area ratio between the first portion and the second portion.

17. The LED light tube of claim 1, wherein the first portion has a lens structure for condensing a light to a light beam and the second portion has a diffusion layer for diffusing the light to a divergent light.

18. The LED light tube of claim 1, wherein an area ratio between the first portion and the second portion is less than ⅓ for a light to pass.

* * * * *